US008791686B2

(12) United States Patent
Yamasaki et al.

(10) Patent No.: US 8,791,686 B2
(45) Date of Patent: Jul. 29, 2014

(54) CONSTANT OUTPUT REFERENCE VOLTAGE CIRCUIT

(75) Inventors: Taro Yamasaki, Chiba (JP); Fumiyasu Utsunomiya, Chiba (JP)

(73) Assignee: Seiko Instruments Inc., Chiba (JP)

( * ) Notice: Subject to any disclaimer, the term of this patent is extended or adjusted under 35 U.S.C. 154(b) by 43 days.

(21) Appl. No.: 13/609,944

(22) Filed: Sep. 11, 2012

(65) Prior Publication Data

US 2013/0076331 A1 Mar. 28, 2013

(30) Foreign Application Priority Data

Sep. 27, 2011 (JP) ..... 2011-211220

(51) Int. Cl.

| | |
|---|---|
| ***G05F 1/10*** | (2006.01) |
| ***G05F 3/02*** | (2006.01) |
| ***G05F 3/16*** | (2006.01) |
| ***G05F 3/20*** | (2006.01) |

(52) U.S. Cl.

USPC ..... 323/315; 323/313; 327/541; 327/543

(58) Field of Classification Search

CPC ..... G05F 5/26; G05F 3/262
USPC ..... 323/313–316, 907; 327/538–546
See application file for complete search history.

(56) References Cited

U.S. PATENT DOCUMENTS

| | | | | |
|---|---|---|---|---|
| 5,646,518 | A * | 7/1997 | Lakshmikumar et al. | 323/316 |
| 5,949,278 | A * | 9/1999 | Oguey | 327/543 |
| 6,285,245 | B1 * | 9/2001 | Watanabe | 327/540 |
| 2002/0158614 | A1 * | 10/2002 | Kimura | 323/315 |
| 2003/0197496 | A1 * | 10/2003 | Wang | 323/315 |
| 2004/0041551 | A1 * | 3/2004 | Mottola et al. | 323/315 |
| 2004/0183515 | A1 * | 9/2004 | Ota et al. | 323/315 |
| 2005/0017795 | A1 * | 1/2005 | Hayakawa | 327/541 |
| 2006/0033557 | A1 * | 2/2006 | Toumazou et al. | 327/541 |
| 2008/0048771 | A1 * | 2/2008 | Watanabe | 327/539 |
| 2009/0146733 | A1 * | 6/2009 | Nakajikkoku | 327/543 |
| 2010/0156386 | A1 * | 6/2010 | Imura | 323/313 |
| 2011/0193544 | A1 * | 8/2011 | Iacob et al. | 323/315 |

FOREIGN PATENT DOCUMENTS

| | | |
|---|---|---|
| JP | 2007-148530 | 6/2007 |

* cited by examiner

*Primary Examiner* — Timothy J Dole
*Assistant Examiner* — Yusef Ahmed
(74) *Attorney, Agent, or Firm* — Brinks Gilson & Lione

(57) ABSTRACT

The voltage reference circuit includes: a first MOS transistor; a second MOS transistor including a gate terminal connected to a gate terminal of the first MOS transistor and having an absolute value of a threshold value and a K value higher than an absolute value of a threshold value and a K value of the first MOS transistor; a current mirror circuit flowing a current based on a difference between the absolute values of the threshold values of the first MOS transistor and the second MOS transistor; a third MOS transistor flowing the current; and a fourth MOS transistor having an absolute value of a threshold value and a K value higher than an absolute value of a threshold value of the third MOS transistor and flowing the current.

2 Claims, 6 Drawing Sheets

CONSTANT OUTPUT REFERENCE VOLTAGE CIRCUIT

RELATED APPLICATIONS

This application claims priority under 35 U.S.C. §119 to Japanese Patent Application No. 2011-211220 filed on Sep. 27, 2011, the entire content of which is hereby incorporated by reference.

BACKGROUND OF THE INVENTION

1. Field of the Invention

The present invention relates to a voltage reference circuit.

2. Background Art

FIG. 6 is a circuit diagram illustrating a conventional voltage reference circuit.

The conventional voltage reference circuit includes PMOS transistors 101 to 103, NMOS transistors 201 to 204 and 301, an output terminal 401, a power supply terminal 501, an earth terminal 502, and a resistor 601. A threshold voltage (hereinafter referred to as $V_{tnl}$) of the NMOS transistor 301 is lower than a threshold voltage (hereinafter referred to as $V_{tnh}$) of the NMOS transistors 201 to 204. The PMOS transistors 102 and 103 constitute current mirror circuits with the PMOS transistor 101 to flow a drain terminal current of a desired ratio to a drain terminal current of the PMOS transistor 101. The NMOS transistor 204 constitutes a current mirror circuit with the NMOS transistor 203 to flow a drain terminal current of a desired ratio to a drain terminal current of the NMOS transistor 203.

Source terminals of the PMOS transistors 101 to 103 are connected to the power supply terminal. Gate terminals of the PMOS transistors 102 and 103 are connected to a gate terminal and a drain terminal of the PMOS transistor 101 and a drain terminal of the NMOS transistor 201. Gate terminals of the NMOS transistors 201 and 202 are connected to a drain terminal of the NMOS transistor 201 and a drain terminal of the PMOS transistor 102. A source terminal of the NMOS transistors 202 is connected to the earth terminal. One end of the resistor 601 is connected to a source terminal of the NMOS transistor 201, and the other end thereof is connected to the earth terminal. Gate terminals of the NMOS transistors 203, 204, and 301 are connected to drain terminals of the NMOS transistors 203 and the PMOS transistor 103. Source terminals of the NMOS transistors 203 and 204 are connected to the earth terminal. A drain terminal of the NMOS transistor 301 is connected to the power supply terminal. The output terminal 401 is connected to a drain terminal of the NMOS transistor 204 and a source terminal of the NMOS transistor 301.

Respective K values of the NMOS transistors 201 to 204 and 301 are $K_{201}$, $K_{202}$, $K_{203}$, $K_{204}$, and $K_{301}$, and a resistance value of the resistor 601 is $R_{601}$.

The PMOS transistors 101 and 102, the NMOS transistors 201 and 202, and the resistor 601 constitute a constant current circuit. For example, in a case where each transistor works in a saturation region, if K values of the PMOS transistors 101 and 102 are equal to each other, currents flowing in the PMOS transistors 101 and 102 are equal to each other, and their current value takes 0A or a certain constant current value (hereinafter referred to as $I_K$). When a start circuit is provided so that the current will not be 0A, the PMOS transistors 101 and 102, the NMOS transistors 201 and 202, and the resistor 601 work as a constant current circuit. The constant current $I_K$ is represented by the following formula:

$$I_K = \frac{1}{R_{601}^2} \cdot \left( \frac{1}{\sqrt{K_{201}}} - \frac{1}{\sqrt{K_{202}}} \right)^2 \quad (1)$$

where $K201 > K202$.

The constant current $I_K$ is mirrored to the PMOS transistor 103, and a drain terminal current of the PMOS transistor 103 is mirrored to the NMOS transistor 204. For example, when all the transistors of FIG. 6 work in a saturation region, K values of the PMOS transistors 101 and 103 are equal to each other, and when K values of the NMOS transistors 203 and 204 are equal to each other, the constant current $I_K$ flows in the NMOS transistors 204 and 301. When respective gate-source voltages necessary for the NMOS transistors 204 and 301 to flow the constant current $I_K$ are assumed $V_{GS204K}$ and $V_{GS301K}$, a voltage (hereinafter referred to as $V_{refK}$) of the output terminal 401 is represented by the following formula with the use of the formula (1):

$$\begin{aligned} V_{refK} &= V_{GS204K} - V_{GS301K} \quad (2) \\ &= \sqrt{I_K}\left( \frac{1}{\sqrt{K_{204}}} - \frac{1}{\sqrt{K_{301}}} \right) + (V_{tnh} - V_{tnl}) \\ &= \frac{1}{R_{601}} \cdot \left( \frac{1}{\sqrt{K_{201}}} - \frac{1}{\sqrt{K_{202}}} \right)\left( \frac{1}{\sqrt{K_{204}}} - \frac{1}{\sqrt{K_{301}}} \right) + (V_{tnh} - V_{tnl}) \end{aligned}$$

where $K201 > K202$.

As mentioned earlier, the voltage reference circuit of FIG. 6 is a circuit to output a reference voltage $V_{refK}$ determined by $V_{tnl}$, $V_{tnh}$, $K_{201}$, $K_{202}$, $K_{204}$, $K_{301}$, and $R_{601}$.

[Patent Document 1] Japanese Patent Application Laid-Open No. 2007-148530

SUMMARY OF THE INVENTION

However, in the conventional voltage reference circuit illustrated in FIG. 6, the resistance value as well as the K values and the threshold values of the transistors determine a reference voltage level according to the formula (2), which causes a problem that an influence on process variation and an influence of temperature characteristics are large. Further, there is also such a problem that variability factors due to process variation increase when correction is performed to reduce a temperature characteristic of the reference voltage level. Further, in order to perform the correction, it is necessary to include a logic circuit for a temperature sensor and correction, which disadvantageously increases a circuit scale.

The present invention has been achieved in view of the above problems, so as to provide a voltage reference circuit which can reduce variability factors due to process variation and easily correct a reference voltage level and a temperature characteristic of the reference voltage level within desired ranges, without increasing a circuit scale.

In order to solve the above problems, a voltage reference circuit according to the present invention includes: a first MOS transistor; a second MOS transistor including a gate terminal connected to a gate terminal of the first MOS transistor and having an absolute value of a threshold value and a K value higher than an absolute value of a threshold value and a K value of the first MOS transistor; a current mirror circuit flowing a current based on a difference between the absolute values of the threshold values of the first MOS transistor and the second MOS transistor; a third MOS transistor flowing the current of the current mirror circuit; and a fourth MOS transistor having an absolute value of a threshold value and a K value higher than an absolute value of a threshold value and a K value of the third MOS transistor and flowing the current of the current mirror circuit, and the voltage reference circuit is configured to output, as a reference voltage, a constant voltage based on the absolute values of the threshold values and the K values of the third MOS transistor and the fourth MOS transistor.

With the use of the voltage reference circuit of the present invention, it is possible to reduce variability in a reference voltage level due to process variation by resistance and variability of corrected values of a reference voltage level and temperature characteristics without increasing a circuit scale.

DESCRIPTION OF THE PREFERRED EMBODIMENTS

The following will describe embodiments of the present invention with reference to drawings.

Embodiment 1

Figure 1:
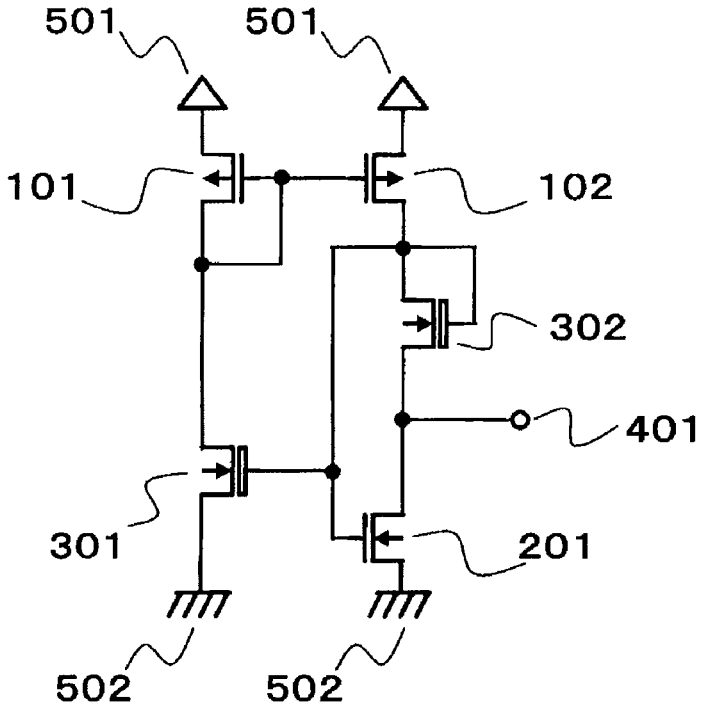
FIG. 1 is a circuit diagram illustrating a voltage reference circuit according to the first embodiment.

FIG. 1 is a circuit diagram illustrating a voltage reference circuit according to the first embodiment.

The voltage reference circuit according to the first embodiment includes PMOS transistors 101 and 102 and NMOS transistors 201, 301, and 302, an output terminal 401, a power supply terminal 501, and an earth terminal 502. A threshold voltage (hereinafter referred to as $V_{tnl}$) of the NMOS transistors 301 and 302 is lower than a threshold voltage (hereinafter referred to as $V_{tnh}$) of the NMOS transistor 201. Respective K values of the NMOS transistors 201, 301, and 302 are $K_{201}$, $K_{301}$, and $K_{302}$. The PMOS transistor 101 and the PMOS transistor 102 constitute current mirror circuits.

Next will be explained connections in the voltage reference circuit according to the first embodiment.

Source terminals of the PMOS transistors 101 and 102 are connected to the power supply terminal 501. A gate terminal of the PMOS transistors 102 is connected to a gate terminal and a drain terminal of the PMOS transistor 101 and a drain terminal of the NMOS transistor 301. Gate terminals of the NMOS transistors 201 and 301 are connected to a drain terminal and a gate terminal of the NMOS transistor 302 and a drain terminal of the PMOS transistor 102, and source terminals thereof are connected to the earth terminal 502. The output terminal 401 is connected to a drain terminal of the NMOS transistor 201 and a source terminal of the NMOS transistor 302.

Next will be explained an operation of the voltage reference circuit according to the first embodiment.

Figure 2:
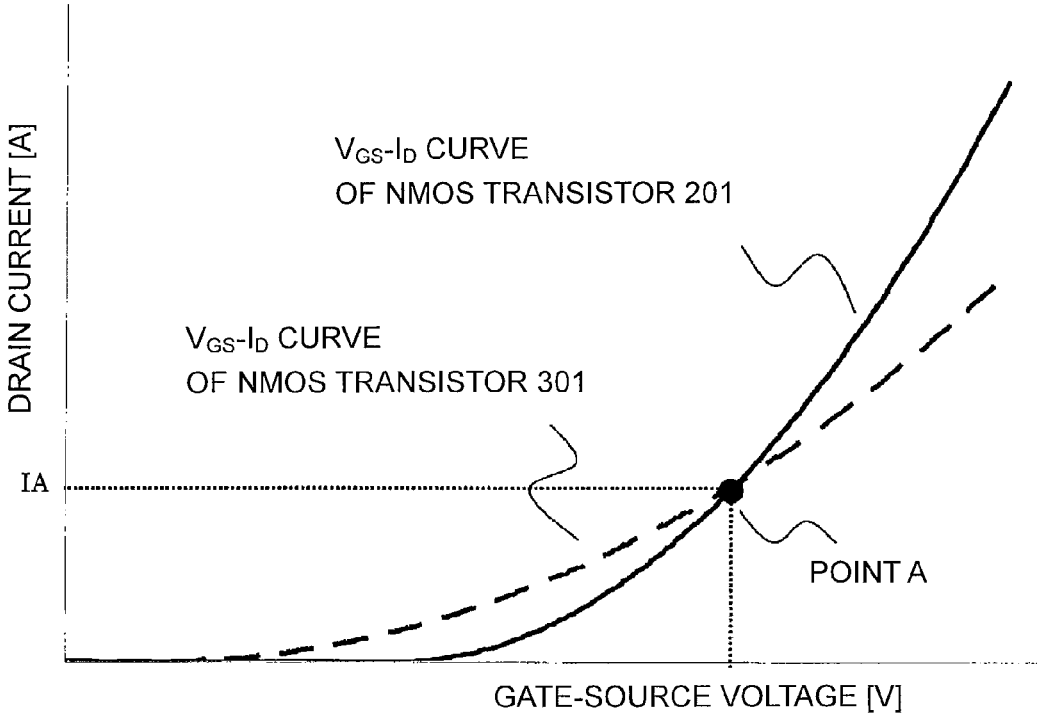
FIG. 2 is a graph illustrating curves of a gate-source voltage relative to a drain terminal current of two NMOS transistors having different threshold values and K values.

Respective drain terminal currents of the PMOS transistors 101 and 102 are assumed $I_{101}$ and $I_{102}$. A voltage of the output terminal 401 is assumed $V_{ref}$. The PMOS transistors 101 and 102 constitute a current mirror circuit, and therefore, if their respective K values are equal to each other, equal currents flow as the current $I_{101}$ and the current $I_{102}$. FIG. 2 illustrates characteristics of a gate-source voltage (hereinafter referred to as $V_{GS}$) relative to a drain terminal voltage (hereinafter referred to $I_D$) when the NMOS transistor 201 and the NMOS transistor 301 work in a saturation region. A rise position and a tilt of each curve are each determined by a threshold voltage and a K value. Since the current $I_{101}$ is equal to the current $I_{102}$ and the gate terminals of the NMOS transistor 201 and the NMOS transistor 301 are connected to each other, when these two transistors work in the saturation region, voltages $V_{GS}$ reach a point A. When a start circuit is provided, the current $I_{101}$ (=$I_{102}$) reaches a current value (hereinafter referred to as $I_A$) at the point A, and this value is represented by the following formula with $V_{tnl}$, $V_{tnh}$, $K_{201}$, and $K_{301}$:

$$I_A = \frac{(V_{tnh} - V_{tnl})^2}{\left(\frac{1}{\sqrt{K_{301}}} - \frac{1}{\sqrt{K_{201}}}\right)^2} \quad (3)$$

where $K_{201} > K_{301}$.

When respective voltages $V_{GS}$ necessary for the NMOS transistors 201 and 302 to flow the current $I_A$ are assumed $V_{GS201A}$ and $V_{GS302A}$, and an earth terminal voltage is assumed VSS, a reference voltage $V_{ref}$ of the output terminal 401 is such that $V_{ref}$=VSS+$V_{GS201A}$−$V_{GS302A}$. Values of the voltage $V_{GS201A}$ and the voltage $V_{GS302A}$ are determined by the values of $I_A$, $V_{tnl}$, $V_{tnh}$, $K_{201}$, and $K_{302}$. The current $I_A$ is determined by the values of $V_{tnl}$, $V_{tnh}$, $K_{201}$, and $K_{301}$ according to the formula (3), and thus, the value of the reference voltage $V_{ref}$ of the output terminal 401 is determined only by the values of $V_{tnh}$, $V_{tnl}$, $K_{201}$, $K_{301}$, and $K_{302}$.

When the NMOS transistor 201 and the NMOS transistor 302 work in the saturation region, the reference voltage $V_{ref}$ is represented by the following formula:

$$\begin{aligned} V_{ref} &= VSS + V_{GS201A} - V_{GS302A} \\ &= VSS + \sqrt{I_A}\left(\frac{1}{\sqrt{K_{201}}} - \frac{1}{\sqrt{K_{202}}}\right) + (V_{tnh} - V_{tnl}) \end{aligned} \quad (4)$$

Here, if all the transistors work in the saturation region, the reference voltage $V_{ref}$ is obtained by substituting the formula (3) for the current $I_A$ in the formula (4), as represented by the following formula:

$$V_{ref} = VSS + \left(\frac{\frac{1}{\sqrt{K_{301}}} - \frac{1}{\sqrt{K_{302}}}}{\frac{1}{\sqrt{K_{301}}} - \frac{1}{\sqrt{K_{201}}}}\right)(V_{tnh} - V_{tnl}) \quad (5)$$

where $K_{201} > K_{301}$.

From the formula (5), it is found that the value of the reference voltage $V_{ref}$ is a voltage determined by $V_{tnh}$, $V_{tnl}$, $K_{201}$, $K_{301}$, and $K_{302}$. Thus, a reference voltage which does not vary depending on process variation of resistance can be obtained. Further, it is possible to easily correct a temperature characteristic by adjusting only the values of $K_{201}$, $K_{301}$, and $K_{302}$.

Here, the above description takes, as an example, a case where the NMOS transistors 201, 301, and 302 work in the saturation region, but even in a case where any of or all of the transistors work in a weak inversion region, if $K_{201}$ and $K_{301}$ are set so that $V_{GS}$–$I_D$ curves of both transistors cross each other, it is possible to create the current $I_A$ determined by the values of $V_{tnl}$, $V_{tnh}$, $K_{201}$, and $K_{301}$ as described above. Further, the reference voltage $V_{ref}$ can be also determined by the values of $V_{tnl}$, $V_{tnh}$, $K_{201}$, $K_{301}$, and $K_{302}$. Therefore, the temperature characteristic can be corrected by adjusting only K values of respective transistors.

Note that the above description takes, as an example, a method in which on the premise that K values in a current mirror circuit are equal to each other, a reference voltage is corrected by adjusting the K values of respective transistors. However, it is also possible to correct a reference voltage level by adjusting a ratio of drain terminal currents of the respective transistors by changing K values of a mirrored pair of the current mirror circuit.

As such, it is possible to obtain a reference voltage which can be easily corrected by adjusting only the values of $K_{201}$, $K_{301}$, and $K_{302}$ so as to correct the temperature characteristic with no variability depending on process variation of resistance.

Embodiment 2

Figure 3:
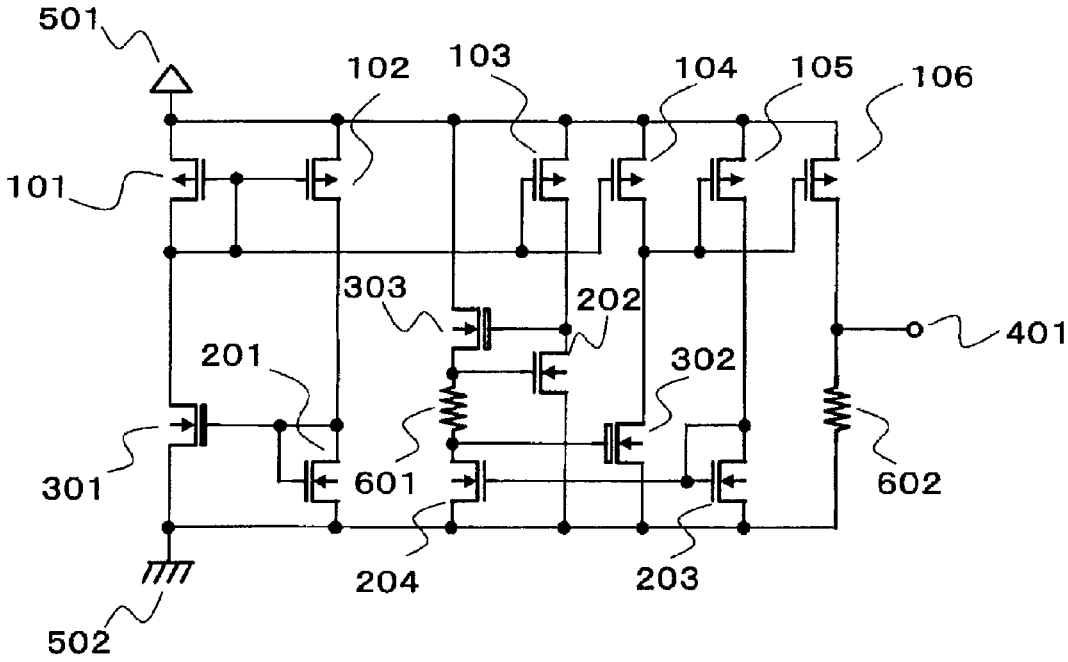
FIG. 3 is a circuit diagram illustrating a voltage reference circuit according to the second embodiment.

FIG. 3 is a circuit diagram illustrating a voltage reference circuit according to the second embodiment.

The voltage reference circuit according to the second embodiment includes PMOS transistors 101 to 106, NMOS transistors 201 to 204 and 301 to 303, an output terminal 401, a power supply terminal 501, an earth terminal 502, and resistors 601 to 602. A threshold voltage (hereinafter referred to as $V_{tnl}$) of the NMOS transistors 301 to 302 is lower than a threshold voltage (hereinafter referred to as $V_{tnh}$) of the NMOS transistors 201 to 202. Respective K values of the NMOS transistors 201, 202, 301, and 302 are $K_{201}$, $K_{202}$, $K_{301}$, and $K_{302}$. Respective resistance values of the resistors 601 and 602 are $R_{601}$ and $R_{602}$. The NMOS transistors 203 and 204 constitute a current mirror circuit. The PMOS transistor 101 and the PMOS transistors 102, 103, and 104 constitute current mirror circuits.

Next will be explained connections of the voltage reference circuit according to the second embodiment.

Source terminals of the PMOS transistors 101 to 106 are connected to the power supply terminal 501. Gate terminals of the PMOS transistors 102 to 104 are connected to a gate terminal and a drain terminal of the PMOS transistor 101 and a drain terminal of the NMOS transistor 301. Gate terminals of the NMOS transistors 201 and 301 are connected to a drain terminal of the NMOS transistor 201 and a drain terminal of the PMOS transistor 102, and source terminals thereof are connected to the earth terminal 502. One end of the resistor 601 is connected to a gate terminal of the NMOS transistor 202 and a source terminal of the NMOS transistor 303, and the other end thereof is connected to a drain terminal of the NMOS transistor 204 and a gate terminal of the NMOS transistor 302. A drain terminal of the NMOS transistors 202 is connected to the drain terminal of the PMOS transistor 103 and to the gate terminal of the NMOS transistor 303, and a source terminal of the NMOS transistors 202 is connected to the earth terminal. A drain terminal of the NMOS transistor 303 is connected to the power supply terminal 501. A drain terminal of the NMOS transistor 302 is connected to a drain terminal of the PMOS transistor 104 and gate terminals of the PMOS transistors 105 and 106, and a source terminal thereof is connected to the earth terminal 502. Gate terminals of the NMOS transistors 203 and 204 are connected to a drain terminal of the NMOS transistor 203 and a drain terminal of the PMOS transistor 105, and source terminals thereof are connected to the earth terminal 502. One end of the resistor 602 is connected to a drain terminal of the PMOS transistor 106, and the other end thereof is connected to the earth terminal 502.

Next will be explained an operation of the voltage reference circuit according to the second embodiment. A voltage of the output terminal 401 is assumed a reference voltage $V_{ref}$. If K values are equal to each other, currents flowing in the PMOS transistors 101 and 102 are a current $I_A$ determined by the values of $V_{tnl}$, $V_{tnh}$, $K_{201}$, and $K_{301}$ as described with reference to the formula (3) in the first embodiment.

As for the currents flowing in the PMOS transistors 103 and 104, since the PMOS transistors 103 and 104 constitute current mirror circuits with the PMOS transistor 101, if their respective K values are the same, the current IA flows therein.

The NMOS transistor 303 controls a gate terminal voltage of the NMOS transistor 202 so that a gate-source voltage of the NMOS transistor 202 reaches a voltage necessary to flow the current $I_A$. The PMOS transistor 104, the NMOS transistor 203, and the NMOS transistor 204 control a gate terminal voltage of the NMOS transistor 302 so that a gate-source voltage of the NMOS transistor 302 reaches a voltage necessary to flow the current $I_A$.

When respective gate-source voltages necessary for the NMOS transistors 202 and 302 to flow the current $I_A$ are assumed a voltage $V_{GS202A}$ and a voltage $V_{Gs302A}$, a voltage $V_{ref2}$ of $V_{GS202A}$–$V_{GS302A}$ appears at both ends of the resistor 601. This voltage $V_{ref2}$ is determined by values of $I_A$, $V_{tnl}$, $V_{tnh}$, $K_{202}$, and $K_{302}$. Since the current $I_A$ is determined by the values of $V_{tnl}$, $V_{tnh}$, $K_{201}$, and $K_{301}$, the voltage $V_{ref2}$ is accordingly determined by the values of $V_{tnl}$, $V_{tnh}$, $K_{201}$, $K_{202}$, $K_{301}$, and $K_{302}$. Thus, a reference voltage which does not vary depending on process variation of resistance can be obtained. Further, a temperature characteristic of the voltage $V_{ref2}$ can be corrected to be flat with respect to temperature characteristics of $I_A$, $V_{GS202A}$, and $V_{GS302A}$ by adjusting the values of $K_{202}$ and $K_{302}$.

When each transistor works in a saturation region, the value of the voltage $V_{ref2}$ is represented by the following formula:

$$V_{ref2} = V_{GS202A} - G_{GS302A} = \left( \frac{\frac{1}{\sqrt{K_{202}}} - \frac{1}{\sqrt{K_{302}}}}{\frac{1}{\sqrt{K_{301}}} - \frac{1}{\sqrt{K_{201}}}} + 1 \right)(V_{tnh} - V_{tnl}) \quad (6)$$

where $K_{201} > K_{301}$.

From the formula (6), it is found that the value of the reference voltage $V_{ref2}$ is a reference voltage determined by $V_{tnh}$, $V_{tnl}$, $K_{201}$, $K_{202}$, $K_{301}$, and $K_{302}$. Further, in order to correct the temperature characteristic, only the values of $K_{201}$, $K_{202}$, $K_{301}$, and $K_{302}$ may be adjusted.

Since the NMOS transistors 203 and 204 constitute a current mirror circuit, and the PMOS transistors 105 and 106 have the same gate-source potential, the same current flows in each transistor. Because of this, the same current flows in the resistors 601 and 602, and the reference voltage $V_{ref}$ of the output terminal 401 is such that $V_{ref}=VSS+V_{ref2}\times(R_{602}/R_{601})$, whereby any reference voltage level obtained by multiplying the voltage $V_{ref2}$ by a resistance ratio $R_{602}/R_{601}$ can be output. Generally, a difference in the resistance ratio in the same chip can be made small to such an extent that the difference can be disregarded, and therefore, any reference voltage which is not affected by process variation due to resistance can be obtained.

In a case of a P-type substrate, the first embodiment causes a back-gate bias on the NMOS transistor 302 and a back-gate bias effect of the NMOS transistor 302 is included in factors to determine a reference voltage level, thereby resulting in that variability factors due to process variation increase. However, the second embodiment does not cause any back-gate bias on a transistor for determining a reference voltage level even when a P-type substrate is used, so that a reference voltage level is determined only by the values of $V_{tnl}$, $V_{tnh}$, $V_{101}$, $K_{201}$, $K_{202}$, $K_{301}$, and $K_{302}$. Therefore, if the configuration according to the second embodiment of the present invention is used, the number of variability factors of a reference voltage due to process variation is small even with the use of a P-type substrate, and further, corrected values of a reference voltage level and its temperature characteristic can be made small.

Here, the NMOS transistors 201 to 204 use transistors having the same threshold voltage $V_{tnh}$. However, if the NMOS transistors 203 and 204 can constitute a current mirror circuit as a pair, the threshold value thereof may be different from that of the NMOS transistors 201 and 202. Further, the NMOS transistors 301 to 303 use transistors having the same threshold voltage $V_{tnl}$, but the NMOS transistor 303 may use a transistor having a threshold voltage which is appropriate for an operation power-supply voltage and different from threshold voltages of the others.

Note that the above description takes, as an example, a method in which on the premise that K values in a current mirror circuit are equal to each other, a reference voltage is corrected by adjusting the K values of respective transistors. However, it is also possible to correct a reference voltage level by adjusting a ratio of drain terminal currents of the respective transistors by changing K values of a mirrored pair of the current mirror circuit.

As such, it is possible to obtain a reference voltage which can be easily corrected by adjusting only the values of $K_{201}$, $K_{202}$, $K_{301}$, and $K_{302}$ so as to correct the temperature characteristic with no variability depending on process variation of resistance.

Embodiment 3

Figure 4:
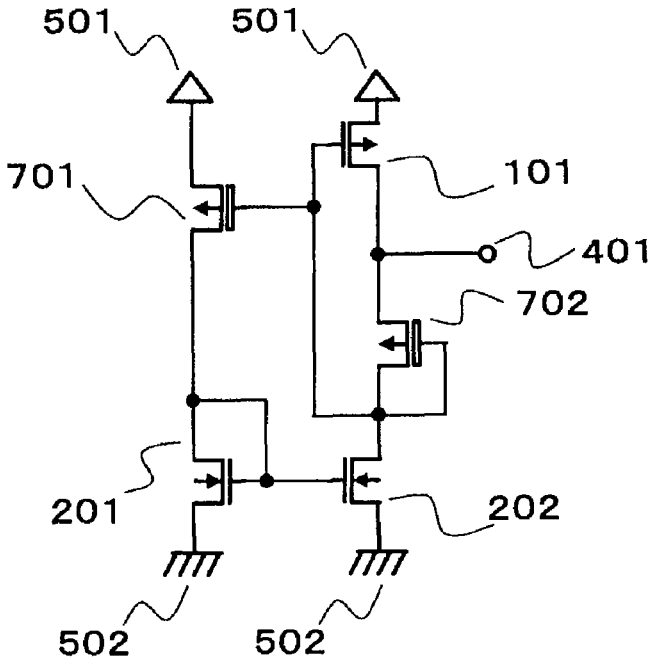
FIG. 4 is a circuit diagram illustrating a voltage reference circuit according to the third embodiment.

FIG. 4 is a circuit diagram illustrating a voltage reference circuit according to the third embodiment.

The voltage reference circuit according to the third embodiment includes PMOS transistors 101, 701, and 702, NMOS transistors 201 and 202, an output terminal 401, a power supply terminal 501, and an earth terminal 502. An absolute value $|V_{tpl}|$ of a threshold voltage (hereinafter referred to as $V_{tpl}$) of the PMOS transistors 701 and 702 is lower than an absolute value $|V_{tph}|$ of a threshold voltage (hereinafter referred to as $V_{tph}$) of the PMOS transistor 101. Respective K values of the PMOS transistors 101, 701, and 702 are $K_{101}$, $K_{701}$, and $K_{702}$. The NMOS transistors 201 and 202 constitute a current mirror circuit.

Next will be explained connections of the voltage reference circuit according to the third embodiment. Source terminals of the NMOS transistors 201 and 202 are connected to the earth terminal 502. A gate terminal of the NMOS transistor 202 is connected to a gate terminal and a drain terminal of the NMOS transistor 201 and a drain terminal of the PMOS transistor 701. Gate terminals of the PMOS transistors 101 and 701 are connected to a drain terminal and a gate terminal of the PMOS transistor 702 and a drain terminal of the NMOS transistor 202, and source terminals thereof are connected to the power supply terminal 501. The output terminal 401 is connected to a drain terminal of the PMOS transistor 101 and a source terminal of the PMOS transistor 702.

Next will be explained an operation of the voltage reference circuit according to the third embodiment. The voltage reference circuit according to the third embodiment is a circuit to form a reference voltage on the basis of a power supply terminal voltage (VDD). A circuit operation is such that roles of the PMOS transistors and the NMOS transistors in the first embodiment are reversed. A current (hereinafter referred to as $I_B$) flowing in the NMOS transistors 201 and 202 is a constant current determined by $V_{tph}$, $V_{tpl}$, $K_{101}$, and $K_{701}$, when a start circuit is provided so that the current is not stable at 0 A at an intersection between $V_{GS}$–$I_D$ curves of the PMOS transistors 101 and 701. When respective gate-source voltages necessary for the PMOS transistors 101 and 702 to flow the current $I_B$ are assumed $V_{GS101B}$ and $V_{GS702B}$, a reference voltage $V_{ref}$ appearing at the output terminal 401 is such that $V_{ref}=VDD-(|V_{GS101B}|-|V_{GS702B}|)$, and its value is determined by $I_B$, $V_{tph}$, $V_{tpl}$, $K_{101}$, and $K_{702}$. Here, since the current $I_B$ is determined by $V_{tph}$, $V_{tpl}$, $K_{101}$, and $K_{701}$, a reference voltage level $V_{ref4}$ is determined only by $V_{tph}$, $V_{tpl}$, $K_{101}$, $K_{701}$, and $K_{702}$. Thus, a reference voltage which does not vary depending on process variation of resistance can be obtained.

Further, by setting the values of $K_{101}$ and $K_{702}$, a temperature characteristic of the reference voltage level $V_{ref}$ can be corrected so as to be flat with respect to temperature characteristics of $I_B$, $V_{GS101B}$, and $V_{GS702B}$.

When all the transistors work in a saturation region, the constant current $I_B$ and the reference voltage $V_{ref}$ are represented by the following formula:

$$I_B = \frac{(|V_{tph}| - |V_{pnl}|)^2}{\left(\frac{1}{\sqrt{K_{701}}} - \frac{1}{\sqrt{K_{101}}}\right)^2} \quad \text{where } K_{101} > K_{701}. \tag{7}$$

$$\begin{aligned} V_{ref} &= VDD - (|V_{GS101B}| - |V_{GS702B}|) \\ &= VDD - \sqrt{I_B}\left(\frac{1}{\sqrt{K_{101}}} - \frac{1}{\sqrt{K_{702}}}\right) - (|V_{tph}| - |V_{tpl}|) \\ &= VDD - \left(\frac{\frac{1}{\sqrt{K_{701}}} - \frac{1}{\sqrt{K_{702}}}}{\frac{1}{\sqrt{K_{701}}} - \frac{1}{\sqrt{K_{101}}}}\right)(|V_{tph}| - |V_{tpl}|) \end{aligned} \quad \text{where } K_{101} > K_{701}. \tag{8}$$

From the formula (8), it is found that the value of the reference voltage $V_{ref}$ is a reference voltage determined by $V_{tph}$, $V_{tpl}$, $K_{101}$, $K_{701}$, and $K_{702}$. Further, in order to correct the temperature characteristic, only the values of $K_{101}$, $K_{701}$, and $K_{702}$ may be adjusted.

Note that the above description takes, as an example, a method in which on the premise that K values in a current mirror circuit are equal to each other, a reference voltage is corrected by adjusting the K values of respective transistors. However, it is also possible to correct a reference voltage level by adjusting a ratio of drain terminal currents of the respective transistors by changing K values of a mirrored pair of the current mirror circuit.

As such, it is possible to obtain a reference voltage which can be easily corrected by adjusting only the values of $K_{101}$, $K_{701}$, and $K_{702}$ so as to correct the temperature characteristic with no variability depending on process variation of resistance.

Embodiment 4

Figure 5:
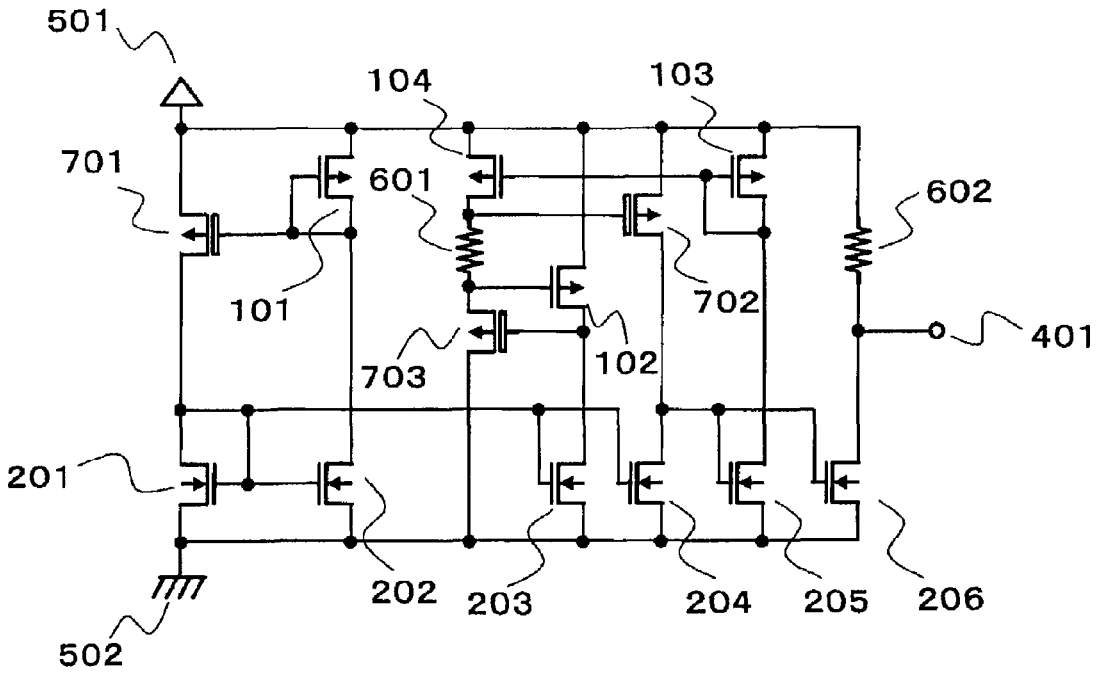
FIG. 5 is a circuit diagram illustrating a voltage reference circuit according to the fourth embodiment.
Figure 6:
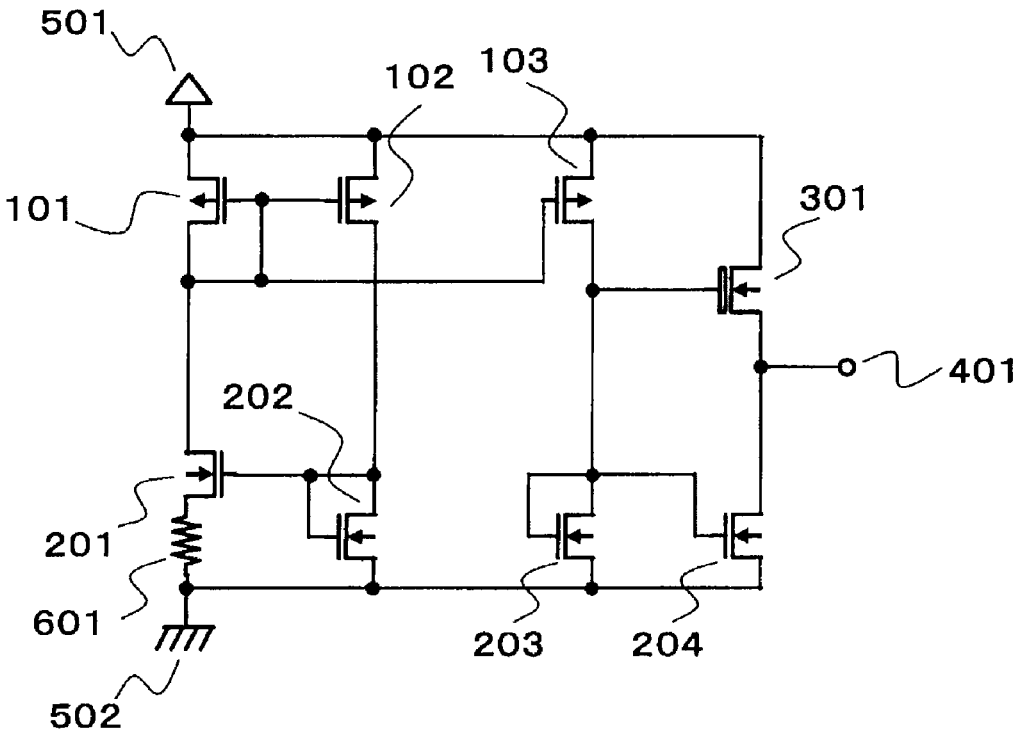
FIG. 6 PRIOR ART
FIG. 6 is a circuit diagram illustrating a conventional voltage reference circuit.

FIG. 5 is a circuit diagram illustrating a voltage reference circuit according to the fourth embodiment.

The voltage reference circuit according to the fourth embodiment includes PMOS transistors 101 to 104 and 701 to 703, NMOS transistors 201 to 206, an output terminal 401, a power supply terminal 501, an earth terminal 502, and resistors 601 and 602. An absolute value $|V_{tpl}|$ of a threshold voltage of the PMOS transistors 701 and 702 is lower than an absolute value $|V_{tph}|$ of a threshold voltage of the PMOS transistors 101 and 102. Respective K values of the PMOS transistors 101, 102, 701, and 702 are $K_{101}$, $K_{102}$, $K_{701}$, and $K_{702}$. Respective resistance values of the resistors 601 and 602 are $R_{601}$ and $R_{602}$. The PMOS transistors 103 and 104 constitute a current mirror circuit, and the NMOS transistor 201 and the NMOS transistors 202, 203, and 204 constitute current mirror circuits.

Next will be explained connections in the voltage reference circuit according to the fourth embodiment. Source terminals of the NMOS transistors 201 to 206 are connected to the earth terminal 502. Gate terminals of the NMOS transistors 202 to 204 are connected to a gate terminal and a drain terminal of the NMOS transistor 201 and a drain terminal of the PMOS transistor 701. Gate terminals of the PMOS transistors 101 and 701 are connected to a drain terminal of the PMOS transistor 101 and a drain terminal of the NMOS transistor 202, and source terminals thereof are connected to the power supply terminal 501. One end of the resistor 601 is connected to a gate terminal of the PMOS transistor 102 and a source terminal of the PMOS transistor 703, and the other end thereof is connected to a drain terminal of the PMOS transistor 104 and a gate terminal of the PMOS transistor 702. A drain terminal of the PMOS transistor 102 is connected to a drain terminal of the NMOS transistor 203 and a gate terminal of the PMOS transistor 703, and a source terminal thereof is connected to the power supply terminal 501. A drain terminal of the PMOS transistor 703 is connected to the earth terminal 502. A drain terminal of the PMOS transistor 702 is connected to a drain terminal of the NMOS transistor 204 and gate terminals of the NMOS transistors 205 and 206, and a source terminal thereof is connected to the power supply terminal 501. Gate terminals of the PMOS transistors 103 and 104 are connected to a drain terminal of the PMOS transistor 103 and a drain terminal of the NMOS transistor 205, and source terminals thereof are connected to the power supply terminal 501. One end of the resistor 602 is connected to a drain terminal of the NMOS transistor 206 and the output terminal 401, and the other end thereof is connected to the power supply terminal 501.

Next will be explained an operation of the voltage reference circuit according to the fourth embodiment. The voltage reference circuit according to the fourth embodiment is such that roles of the PMOS transistors and the NMOS transistors in the second embodiment are reversed. A current flowing in the NMOS transistors 201 to 204 is the constant current ($I_B$) determined by $V_{tph}$, $V_{tph}$, $K_{101}$, and $K_{701}$ as described in the third embodiment. When respective voltages $V_{GS}$ necessary for the PMOS transistors 102 and 702 to flow the current $I_B$ are assumed $V_{GS102B}$ and $V_{GS702B}$, a reference voltage $V_{ref5}$ appearing at both ends of the resistor 601 is such that $V_{ref5}=|V_{GS102B}|-|V_{GS702B}|$, and its value is determined by $I_B$, $V_{tpl}$, $V_{tph}$, $K_{102}$, and $K_{702}$. Since the current $I_B$ is determined by $V_{tph}$, $V_{tpl}$, $K_{101}$, and $K_{701}$, it is possible to obtain, by taking out the voltage $V_{ref5}$, a reference voltage which is determined by the values of $V_{tph}$, $V_{tpl}$, $K_{101}$, $K_{102}$, $K_{701}$, and $K_{702}$ and which does not vary depending on process variation due to resistance. Further, by adjusting the values of $K_{102}$ and $K_{702}$, a temperature characteristic of the voltage $V_{ref5}$ can be corrected so as to be flat with respect to temperature characteristics of $I_B$, $V_{GS102B}$, and $V_{GS702B}$.

When all the transistors work in a saturation region, the voltage $V_{ref5}$ is represented by the following formula:

$$V_{ref5} = |V_{GS102B}| - |V_{GS702B}| = \left( \frac{\frac{1}{\sqrt{K_{102}}} - \frac{1}{\sqrt{K_{702}}}}{\frac{1}{\sqrt{K_{702}}} - \frac{1}{\sqrt{K_{101}}}} + 1 \right) (|Vtph| - |Vtpl|) \quad (9)$$

where $K_{101} > K_{701}$.

From the formula (9), it is found that the value of the voltage $V_{ref5}$ is a reference voltage determined by $V_{tph}$, $V_{tpl}$, $K_{101}$, $K_{102}$, $K_{701}$, and $K_{702}$. Further, in order to correct the temperature characteristic, only the values of $K_{101}$, $K_{102}$, $K_{701}$, and $K_{702}$ may be adjusted.

Since the same current flows in the PMOS transistor 104 and the NMOS transistor 206, the reference voltage $V_{ref}$ of the output terminal 401 is such that $V_{ref}=VDD-V_{ref5}\times(R_{602}/R_{601})$, whereby any reference voltage level which is based on a power supply terminal voltage and which is obtained by multiplying the voltage $V_{ref5}$ by $R_{602}/R_{601}$ can be output. Generally, because a difference in the resistance ratio in the same chip can be made small to such an extent that the difference can be disregarded, any reference voltage which is not affected by process variation due to resistance can be obtained.

The voltage reference circuit according to the fourth embodiment is a circuit to form a reference voltage on the basis of a power supply terminal voltage (VDD), and is a circuit in which a reference voltage level is not affected by a back-gate bias effect when an N-type substrate is used. The circuit according to the third embodiment causes a back-gate bias on the PMOS transistor 702 in FIG. 4, and a back-gate bias effect of the PMOS transistor 702 is included in factors to determine a reference voltage level, thereby resulting in that variability factors due to process variation increase. However, the fourth embodiment does not cause any back-gate bias on a transistor for determining a reference voltage level even when an N-type substrate is used, so that the reference voltage level is determined only by the values of $V_{tpl}$, $V_{tph}$, $K_{101}$, $K_{102}$, $K_{701}$, and $K_{702}$. Therefore, if the configuration according to the fourth embodiment of the present invention is used, the number of variability factors due to process variation is small even with the use of an N-type substrate, and further, corrected values of a reference voltage level and its temperature characteristic can be made small.

Here, the PMOS transistors 101 to 104 use transistors having the same threshold voltage $V_{tph}$. However, if the PMOS transistors 103 and 104 constitute a current mirror circuit, the threshold value thereof may be different from that of the NMOS transistors 101 and 102. Further, the PMOS transistors 701 to 703 use transistors having the same threshold voltage $V_{tpl}$, but the PMOS transistor 703 may use a transistor having a threshold voltage which is appropriate and different from threshold voltages of the others, according to an operation power-supply voltage.

Note that the above description takes, as an example, a method in which on the premise that K values in a current mirror circuit are equal to each other, a reference voltage is corrected by adjusting the K values of respective transistors. However, it is also possible to correct a reference voltage level by adjusting a ratio of drain terminal currents of respective transistors by changing K values of a mirrored pair of the current mirror circuit.

As such, it is possible to obtain a reference voltage which can be easily corrected by adjusting only the values of $K_{101}$, $K_{102}$, $K_{701}$, and $K_{702}$ so as to correct the temperature characteristic with no variability depending on process variation of resistance.

As discussed above, a voltage reference circuit according to the present invention may include: a first MOS transistor; a second MOS transistor including a gate terminal connected to a gate terminal of the first MOS transistor and having an absolute value of a threshold value and a K value higher than an absolute value of a threshold value and a K value of the first MOS transistor; a current mirror circuit flowing a current based on a difference between the absolute values of the threshold values of the first MOS transistor and the second MOS transistor; a third MOS transistor flowing the current of the current mirror circuit; and a fourth MOS transistor having an absolute value of a threshold value and a K value higher than an absolute value of a threshold value and a K value of the third MOS transistor and flowing the current of the current mirror circuit, and the voltage reference circuit may be configured to output, as a reference voltage, a constant voltage based on the absolute values of the threshold values and the K values of the third MOS transistor and the fourth MOS transistor.

Accordingly, circuits which generate a constant voltage of a voltage reference circuit as shown in the embodiments and circuit which output the constant voltage as a reference voltage are only examples, and the present invention is not limited to these circuits.

What is claimed is:

1. A voltage reference circuit comprising: a first MOS transistor including a source terminal connected to a first power supply terminal; a second MOS transistor including a source terminal connected to the first power supply terminal and a gate terminal connected to a gate terminal of the first MOS transistor, the second MOS transistor having an absolute value of a threshold value higher than an absolute value of a threshold value of the first MOS transistor; a current mirror circuit flowing a current based on a difference between the absolute values of the threshold values of the first MOS transistor and the second MOS transistor; a third MOS transistor flowing the current of the current mirror circuit; a fourth MOS transistor having an absolute value of a threshold value higher than an absolute value of a threshold value of the third MOS transistor and flowing the current of the current mirror circuit, wherein the voltage reference circuit outputs, as a reference voltage, a constant voltage based on the absolute values of the threshold values of the third MOS transistor and the fourth MOS transistor; wherein the current mirror circuit includes: a fifth MOS transistor including a drain terminal and a gate terminal connected to a drain terminal of the first MOS transistor; a sixth MOS transistor including a gate terminal connected to the gate terminal of the fifth MOS transistor and a drain terminal connected to the gate terminal and a drain terminal of the second MOS transistor; a seventh MOS transistor including a gate terminal connected to the gate terminal of the fifth MOS transistor and a drain terminal connected to a drain terminal of the third MOS transistor; an eighth MOS transistor including a gate terminal connected to the gate terminal of the fifth MOS transistor and a drain terminal connected to a drain terminal of the fourth MOS transistor; and a resistor including one terminal connected to a gate terminal of the third MOS transistor and another terminal connected to a gate terminal of the fourth MOS transistor, wherein the voltage reference circuit outputs, as a reference voltage, a constant voltage based on a voltage at both ends of the resistor.

2. A voltage reference circuit comprising: a first MOS transistor including a source terminal connected to a first power supply terminal; a second MOS transistor including a source terminal connected to the first power supply terminal and a gate terminal connected to a gate terminal of the first MOS transistor, the second MOS transistor having an absolute value of a threshold value higher than an absolute value of a threshold value of the first MOS transistor; a current mirror circuit flowing a current based on a difference between the absolute values of the threshold values of the first MOS transistor and the second MOS transistor; a third MOS transistor flowing the current of the current mirror circuit; wherein the current mirror circuit includes: a fourth MOS transistor including a drain terminal and a gate terminal connected to a drain terminal of the first MOS transistor; and a fifth MOS transistor including a gate terminal connected to the gate terminal of the fourth MOS transistor and a drain terminal connected to a gate terminal and a drain terminal of the third MOS transistor, wherein the third MOS transistor is configured to include a gate terminal connected to the gate terminal of the second MOS transistor and a source terminal connected to a drain terminal of the second MOS transistor, so that the voltage reference circuit outputs the reference voltage from a connecting point of the source terminal of the third MOS transistor and the drain terminal of the second MOS transistor; and wherein the voltage reference circuit outputs, as a reference voltage, a constant voltage based on the absolute values of the threshold values of the third MOS transistor and the second MOS transistor.

* * * * *